United States Patent [19]

Lindtveit

[11] 4,416,592

[45] Nov. 22, 1983

[54] LIQUID FLOW CONTROL APPARATUS

[75] Inventor: Herbert E. Lindtveit, Centerport, N.Y.

[73] Assignee: Sid Harvey, Inc., Valley Stream, N.Y.

[21] Appl. No.: 254,469

[22] Filed: Apr. 15, 1981

[51] Int. Cl.[3] ..... F04B 49/04; F04B 49/08

[52] U.S. Cl. ..... 417/290; 417/299; 417/304

[58] Field of Search ..... 137/115, 116, 117; 417/290, 297.5, 299, 300, 304, 307

[56] References Cited

U.S. PATENT DOCUMENTS

| | | | |
|---|---|---|---|
| 2,293,071 | 8/1942 | Morgensen | 417/297.5 |
| 2,627,868 | 2/1953 | Runnels | 137/202 |
| 3,948,147 | 4/1976 | Sauer | 417/299 |
| 4,062,384 | 12/1977 | Frahm | 137/202 |
| 4,269,572 | 5/1981 | Nozawa | 417/299 |
| 4,350,476 | 9/1982 | Eller | 417/304 |

*Primary Examiner*—Richard E. Gluck
*Assistant Examiner*—Jane E. Obee
*Attorney, Agent, or Firm*—Cooper, Dunham, Clark, Griffin & Moran

[57] ABSTRACT

This liquid flow control apparatus is a delayed closure valve mechanism intended for use in an unloading bypass between the outlet and the inlet of a pump for supplying fuel to an oil burner. The valve mechanism includes a conduit having a large diameter section between two small diameter sections. A ball valve having a diameter smaller than the large diameter section and larger than the two small diameter sections is captured within the large diameter section. The large diameter section extends upwardly, so that the ball is biased by gravity to its inlet end. When the pump starts, the ball is moved by the discharge pressure of the pump until it engages the upper end of the large diameter section, whereupon the unloading bypass is closed and the discharge pressure of the pump is effective to open a cut-off valve leading to the nozzle of the oil burner. The length of the large diameter section determines the time delay between the starting of the pump and the delivery of oil to the nozzle of the burner. In a modification, two parallel paths are provided for the ball valve, a first long path through which the ball moves to establish the time delay, and a second shorter path through which the ball moves quickly to return to its inactive position.

1 Claim, 4 Drawing Figures

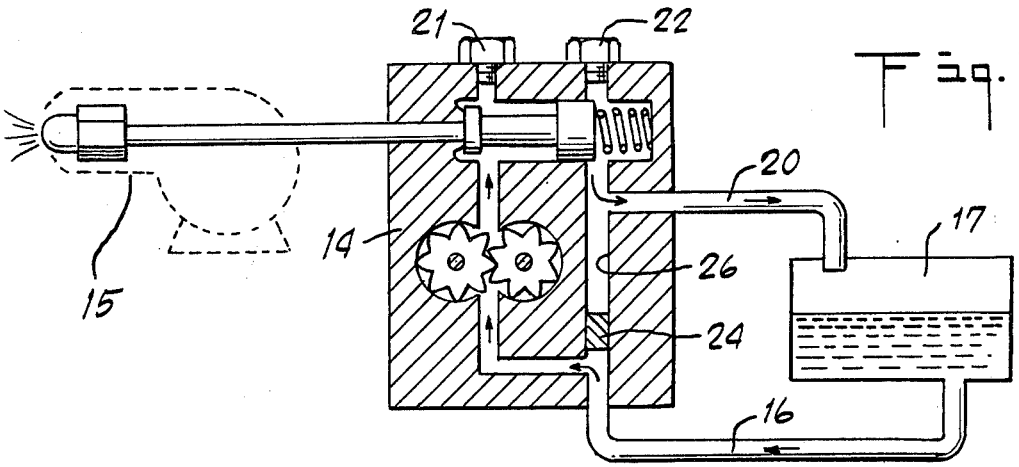
Fig. 2.
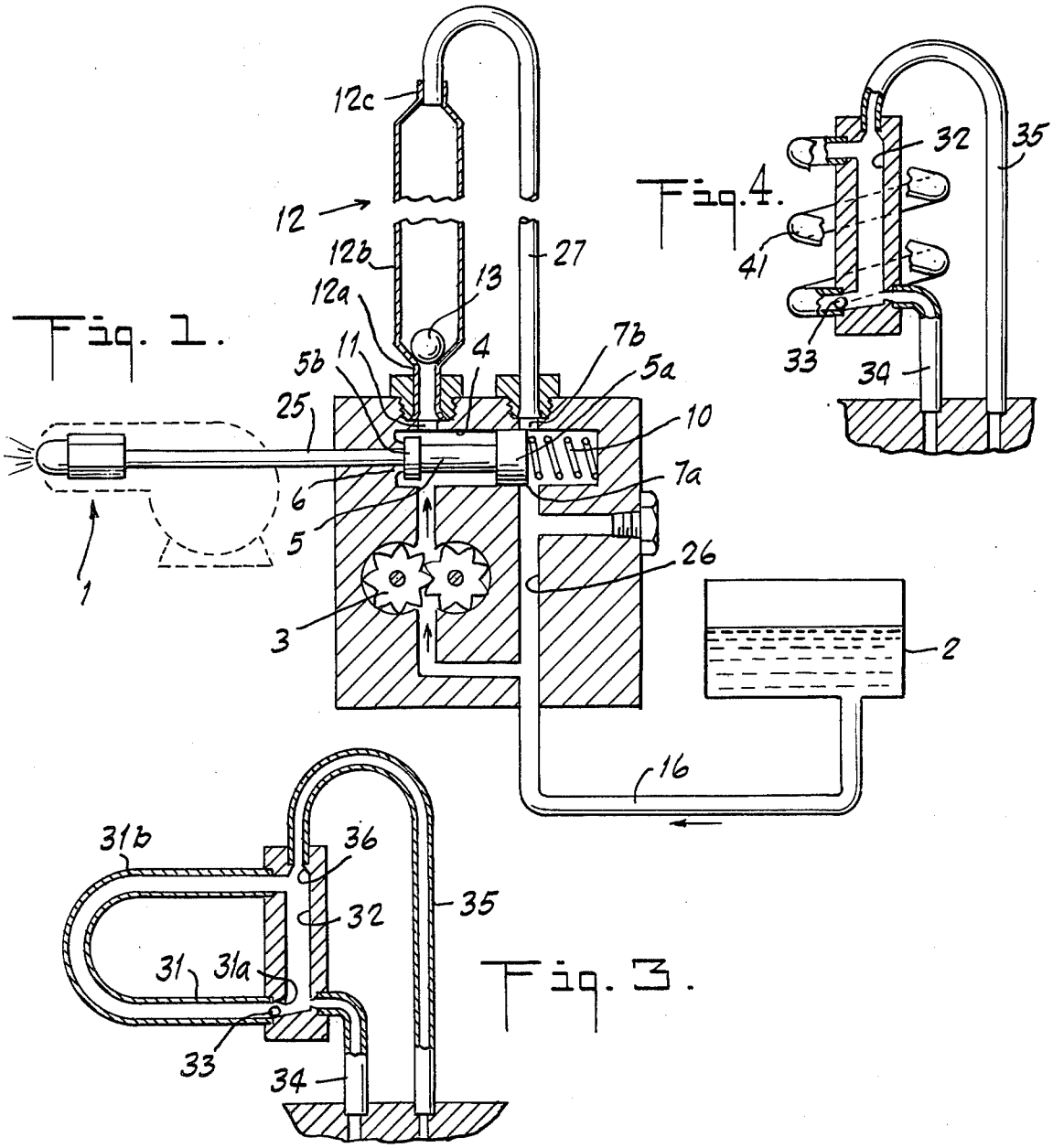
Fig. 1.
Fig. 4.
Fig. 3.

LIQUID FLOW CONTROL APPARATUS

BRIEF SUMMARY OF THE INVENTION

This liquid flow control apparatus is particularly intended for use with an oil burner. It operates upon first initiation of the burner operation to delay the opening of a valve between the pump and the burner nozzle, so as to avoid delivery of oil to the combustion chamber until after a flow of air through the combustion chamber has been established by a fan which runs concurrently with the pump.

It is conventional in oil burners (see for example, Logan et al U.S. Pat. No. 2,662,477) to provide a pressure regulating valve controlling a bypass from the pump outlet back to the pump inlet, for the purpose of maintaining a constant pump discharge pressure. It is also conventional to provide a cut-off valve between the pressure regulating valve and the nozzle to ensure that the oil does not drip from the burner when the pump is not running. It is also known to provide a second bypass from the outlet of the pump to its inlet for the purpose of unloading the pump when it first starts up. This second bypass is closed a short time after the pump starts, so that the pump initiates its delivery to the burner nozzle at the full designed outlet pressure. The Logan et al U.S. Pat. No. 2,662,477 is particularly concerned with such a bypass.

The present invention concerns an improved and simplified bypass with a delayed closure for an oil burner pump. It is particularly intended that the bypass with delayed closure of the present invention may be attached to an existing oil burner pump which does not have such a bypass. Alternatively, it may be used as a replacement for an existing delayed closure bypass on an oil burner pump.

While the invention is described in detail in connection with an oil burner pump, it is applicable to other situations where a delayed delivery of liquid may be desirable.

DRAWING

FIG. 1 is a somewhat diagrammatic view of an oil burner pump system having a bypass with a time delayed closure constructed in accordance with the invention.

FIG. 2 is a view similar to a portion of FIG. 1, of an oil burner pump system using two pipes between the supply tank and the pump.

FIG. 3 is a somewhat diagrammatic view showing a modified form of bypass with time delayed closure, which is usable in the oil burner system of either FIG. 1 or FIG. 2.

FIG. 4 is a view, similar to FIG. 3, showing another modification of the invention.

DETAILED DESCRIPTION

There is shown in FIG. 1 an oil burner generally indicated at 1 which receives oil flowing from a tank 2 through a pump 3. The pump 3 delivers oil into a chamber 4 enclosing a valve stem 5 having at its right-hand end a pressure regulating valve 5*a* and at its left-hand end a cutoff valve 5*b*. The cutoff valve 5*b* cooperates with a seat 6 formed in the left end wall of the chamber 4. The opening in seat 6 communicates through a pipe 25 with the nozzle of oil burner 1. The pressure regulating valve 5*a* cooperates with a pair of ports 7*a*, 7*b*, located at opposite sides of the chamber 4. Port 7*a* is connected through a conduit 26 and an inlet pipe 16 to the tank 2. The chamber 4, the valve 5*a* and the conduit 26 together constitute a pressure regulating bypass between the outlet and the inlet of pump 3. A spring 10 is held in compression between the right-hand end of piston 5*a* and the end of the chamber 4 and biases the valves 5*a* and 5*b* to the closed position of cutoff valve 5*b*, as shown in the drawing. In this position of valve 5*b*, the pressure regulating bypass is also closed.

A port 11 opens into the chamber 4 opposite the discharge part of the pump 3. The port 11 leads into an unloading bypass including a delayed closure valve mechanism 12 and a conduit 27. The valve mechanism 12 comprises a small diameter section 12*a*, an upwardly extending large diameter section 12*b* and another small diameter section 12*c*. The large diameter section 12*b* is connected to the small diameter section 12*a* and 12*c* by conical tapered connections.

A valve member 13, shown as a ball, is located in the valve mechanism 12. The diameter of the valve member 13 is smaller than that of the section 12*b* and larger than those of the sections 12*a* and 12*c*. The valve member 13 is shown in its rest position at the bottom of the large diameter section 12*b*, seated on the lower conical tapered portion of that valve mechanism.

OPERATION

When the pump 3 is started, it delivers liquid fuel into the chamber 4 through the port 11 against the ball 13. The ball 13 acts as a restriction in the large diameter section and a pressure difference is established across the ball tending to move the ball upwardly through the section 12*b*. After a time determined by the diameter of ball 13 and the length and inside diameter of the section 12*b*, the ball 13 reaches the upper end of the large diameter section and seats against the upper conical end portion, whereupon flow through the large diameter section 12*c* is stopped.

The pressure then builds up in the chamber 4, forcing the valve 5*a* to the right against the spring 10, and opening the cutoff valve 5*b* so that oil may flow to the burner 1. The valve 5*a* continues to the right until its left-hand edge passes the ports 7, whereupon a bypass is established between the outlet and the inlet of the pump to maintain the pressure within a regulated range determined by the spring 10 and the valve 5*a* as is known in the art. Thus, the initial flow of oil to the burner nozzle takes place at the full designed operating pressure, and there is no dribbling or dripping of oil into the combustion chamber.

The ball 13 is held against the upper end of the large diameter section 12*b* as long as the pump continues to run. When the pump stops, the ball falls again to the bottom of the section 12*b* and the time delay mechanism is ready to repeat on the next start of the oil burner.

FIG. 2 shows a similar oil burner including a pump 14 and a burner 15. The pump 14 is provided with an inlet line 16 from a tank 17 and a return line 20 to the tank 17. The casing of the pump 14 is provided with ports closed by plugs 21 and 22 for the attachment of pressure gages during testing and repair operations. These plugs 21 and 22 may be removed and delayed flow control apparatus such as shown at 12 and 27 in FIG. 1 may be attached to those ports so as to provide initial delivery characteristics of the oil burner pump similar to those of the pump 3 in FIG. 1.

In the pump 14, the conduit 26 is closed by a plug 24.

FIG. 3 shows a modified form of delayed closure valve mechanism in which the large diameter section of the bypass conduit means comprises two parallel conduits 31 and 32. A first parallel conduit 31 is relatively longer than the second conduit 32 and includes a portion 31*a* extending downwardly in the direction of flow adjacent the inlet end, followed by a longer curved portion 31*b* extending upwardly to a locality adjacent the outlet end. The second conduit 32 is straight and relatively short and extends directly between the inlet and the outlet end. A ball valve member 33 rests at the lower point of the conduit 31. When the pump starts, oil under pressure is supplied to a pipe 34 and passes through the parallel pipes 31 and 32 into the bypass conduit 35. The flowing oil carries the ball 33 along the pipe 31 and up through its U-shaped configuration to the top of the pipe 32. When the ball reaches that position, the oil pressure forces it against a conical seat 36, where it is effective to stop the flow. When the pump stops the ball falls directly downwardly to the pipe 32 and comes to rest in its starting position, as shown in the drawing.

FIG. 4

This figure illustrates a modification of the time delay structure of FIG. 3. The only difference is in the configuration of the conduit 41 which replaces the conduit 31 of FIG. 3. The conduit 41 is shown as having a helical contour and is wound around the conduit 32. The modification shown in FIG. 4 is preferred to the other modifications, since it is of a smaller dimension and takes up considerably less space for a given delay time. Its operation is exactly analogous to the time delay valve mechanism of FIG. 3. The parts appearing in FIG. 4 which are similar in structure and function to their counterparts in FIG. 3 have been given the same reference numeral and will not be further described. It should be apparent from a consideration of FIGS. 3 and 4 that the contour of the conduit 31 or 41 is not critical, but may be curved as desired. It should, however, extend continuously upward from its low point at 31*a* to its upper connection with the conduit 32.

Summarizing, the invention comprises a liquid flow control apparatus including a simplified delayed closure valve. It may be added to an oil burner pump system which was not initially equipped with such a valve. As an alternative, it may be supplied as original equipment in such an oil burner pump system. As another alternative, it may be used as a replacement for another delayed closure valve. It may also be used in systems of other types, where delayed closure of a valve is required.

I claim:

1. Apparatus for controlling the flow of a liquid from a source (3) to a sump (26) so as to permit the flow for a predetermined time and then to terminate the flow, comprising:

a. conduit means (31,32,35 or 41,32,35) having an inlet end (34) adapted for connection to the source and an outlet end (35) adapted for connection to the sump, said conduit means including an elongated large diameter section (31,32 or 41,32) between two small diameter sections (34,35); and b. a valve member (33) captured in the large diameter section and having a diameter smaller than the diameter of the large diameter section and greater than the diameter of the small diameter sections; said valve member being small as compared to the length of the large diameter section, said valve member being biased toward the inlet end of said large diameter section and reposing adjacent said inlet end in the absence of flow through the conduit means, and being movable toward the outlet end by the flow of liquid, said valve member being moved to engage said outlet end by a flow of liquid through the conduit means for a substantial time determined by the relative dimensions of the valve member and the large diameter section, said valve member being effective upon engagement with said outlet end to block the flow of liquid through the conduit means;

c. said large diameter section comprising first and second conduits extending between the inlet end and the outlet end, said first conduit being relatively long and having a portion extending downwardly in the direction of flow adjacent said inlet end, followed by a portion extending from the lower end of said downwardly extending portion to a locality adjacent said outlet end;

d. said second conduit being relatively short and extending continuously upwardly; and e. said valve member is biased by gravity to said lower end, and is moved through said first conduit toward said outlet end by the flow of liquid from said source, and returns by gravity to said lower end through said second conduit when the flow ceases.

* * * * *